United States Patent [19]

Lude

[11] 4,356,591

[45] Nov. 2, 1982

[54] VACUUM CLEANER

[75] Inventor: Ernst Lude, Stuttgart, Fed. Rep. of Germany

[73] Assignee: Rommag P. Wörwag & Co., Romanshorn, Switzerland

[21] Appl. No.: 204,360

[22] Filed: Nov. 5, 1980

[30] Foreign Application Priority Data

Nov. 6, 1979 [DE] Fed. Rep. of Germany ..... 2944749

[51] Int. Cl.[3] ..... A47L 9/00

[52] U.S. Cl. ..... 15/326; 55/276; 181/231; 417/312

[58] Field of Search ..... 15/326; 55/276; 181/231; 417/312

[56] References Cited

U.S. PATENT DOCUMENTS

| | | | |
|---|---|---|---|
| 1,565,932 | 12/1925 | Hanson | 15/326 X |
| 2,731,194 | 1/1956 | Kent | 417/312 |
| 2,962,118 | 11/1960 | Lee et al. | 55/276 |
| 3,308,608 | 3/1967 | Brimberg | 15/326 X |

*Primary Examiner*—Chris K. Moore

*Attorney, Agent, or Firm*—Becker & Becker, Inc.

[57] ABSTRACT

A vacuum cleaner with a housing having a hood and at least one suction connection and at least one discharge opening, as well as with a dust filter and a suction apparatus provided with a blower and an electric motor, with the suction apparatus being surrounded by the hood. A noise damping or insulating device is arranged between the inner surface of the hood and the suction apparatus. The noise damping device has a damping sleeve surrounding the suction apparatus in the manner of a mantle.

10 Claims, 1 Drawing Figure

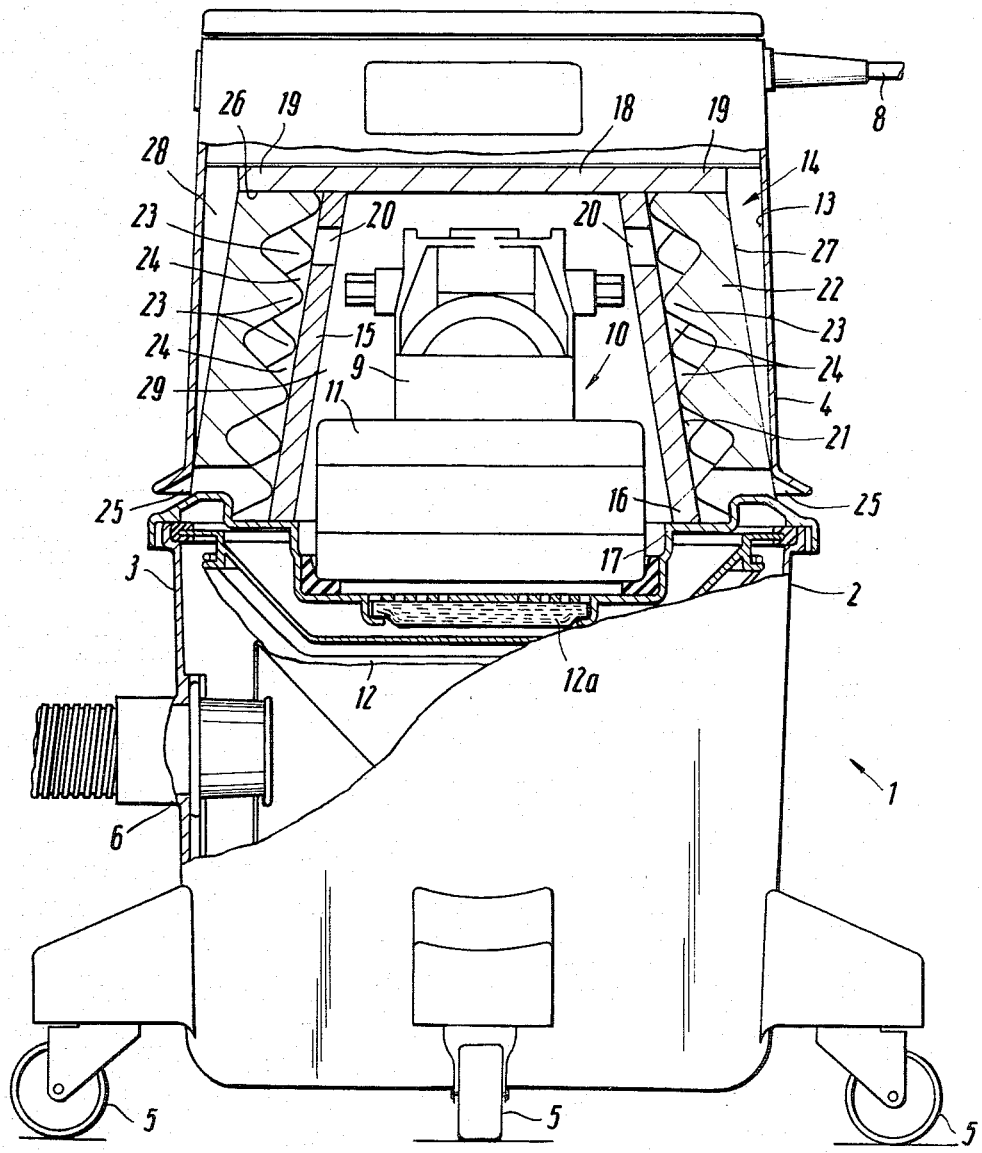
26
19
18
19
8
28
14
13
23
20
20
27
24
22
23
15
10
23
24
9
24
29
11
4
21
25
16
25
3
17
2
12
12a
1
6
5
5
5

VACUUM CLEANER

The present invention relates to a vacuum cleaner with a housing having a hood and at least one suction connection and at least one discharge opening; the vacuum cleaner also includes a dust filter and a suction apparatus having an electric motor as well as a blower, the suction apparatus being surrounded by the hood.

For the purpose of obtaining a high cleaning capacity in electrical vacuum cleaners which are used both in the household and also commercially, to an increasing extent motors with higher capacities are being installed. Under these circumstances, it is disadvantageous that with increasing suction capacity simultaneously a higher noise level occurs, which is caused essentially by the running noise of the suction apparatus and the flow noise of the vacuum intake air. The noise level of the vacuum cleaner is disturbing, and not only operating personnel but also other persons in the vicinity of the vacuum cleaner consider such noise extremely annoying.

It is therefore an object of the present invention to improve a vacuum cleaner of the type initially described in such a way that with simple, cost advantageous means a highly effective noise reduction is obtained, whereby not only a reduction of the sound conducted through the vacuum cleaner, but also of the air flow noise, is to be obtained.

This object, and further objects and advantages of the present invention, will appear more clearly from the following specification in connection with the accompanying drawing, which schematically illustrates a preferred embodiment of the inventive vacuum cleaner.

The vacuum cleaner of the present invention is characterized primarily by arranging a noise damping device between the inner surface of the hood and the suction apparatus.

Consequently, the advantage is attained that the sound waves caused by the suction apparatus are extensively absorbed by the sound damping device which surrounds the suction apparatus. Likewise, a large portion of the sound waves brought about by the air flow are absorbed by the sound damping device. For this reason, only a small portion of the sound oscillations are given off to the environment by means of the housing of the vacuum cleaner and by means of the discharging, filtered suction air. Consequently, externally of the vacuum cleaner only quiet running noises are noticeable, so that the vacuum cleaner can be utilized for cleaning, for instance, office space, even when other persons are occupied, for instance doing office work, without these other persons being bothered by the vacuum cleaner noise.

Preferred embodiments and further developments of the present invention are apparent from the following paragraphs. By application thereof in an advantageous manner, a highly effective, multiple step sound damping function is obtained.

For instance, the sound damping device may be provided with a damping sleeve which surrounds the suction apparatus in the manner of a mantle. The damping sleeve may be embodied in a truncated cone form, and may have a damping plate on one side which covers the suction apparatus.

The taper of the truncated-cone shaped damping sleeve may extend in the flow direction of the suction apparatus, whereby that end face of the damping sleeve remote from the damping plate faces the dust filter; and the damping sleeve may be provided with at least one opening in the vicinity of the damping plate.

A damping element may be arranged on the outer peripheral surface of the damping sleeve, with at least one flow passage being arranged between the damping element and the damping sleeve; the starting region of this flow passage is connected with the opening of the damping sleeve, and the end region thereof is connected with a discharge opening provided in the hood.

The damping element may be provided with projecting humps which extend into the flow passage. The protuberances or humps may be essentially conical or pyramidal, with their free ends engaging the peripheral surface of the damping sleeve. The protuberances or humps may be staggered relative to one another so as to divert the flow in the flow passage in an essentially zigzag manner.

The total thickness of the damping element may be greater than the wall thickness of the damping sleeve. The damping element may be embodied having a truncated cone-shape in essence like the damping sleeve. One end face of the damping element may engage against an extension of the damping plate which extends beyond the damping sleeve. A free space may be formed between the inner surface of the hood and the outer surface of the damping element.

Referring now in detail to the drawing, the vacuum cleaner 1 illustrated partially in section has a housing 2 with a lower part 3 and a hood 4. Rollers 5 as well as a suction connection 6 having a flexible suction hose 7 are arranged on the lower part 3. A cord or electric cable 8 is introduced through the hood 4 for supplying voltage or power to an electric motor 9. The electric motor 9 is part of a suction apparatus 10 and drives a blower or fan 11. Dust filters 12 and **12*a* are arranged below the blower 11**.

A noise damping device 14 is arranged in the region of the hood 4 of the housing 2 between the inner surface 13 and the suction apparatus 10. This noise damping device 14 covers the suction apparatus 10 in the manner of a hood as a noise insulating mantle or jacket. The noise damping device 14 is provided with a damping hull or sleeve 15 which is made of sound-absorbing material, surrounds the suction apparatus 10 in the manner of a mantle, and is embodied in a truncated cone form. That end face 16 in the region of the larger cross section of the damping sleeve 15 engages a support wall 17 in the vicinity of the dust filter 12. The damping sleeve 15 tapers in the direction of flow of the vacuum exhaust air, and is covered by a damping plate 18 on that side facing away, or remote, from the end face 16 in the region of the smaller cross section. This damping plate 18 likewise comprises a noise damping material, and has an extension 19 which projects beyond the damping sleeve 15. Openings 20 are arranged in the damping sleeve 15 slightly below the damping plate 18. These openings 20 pass transversely through the wall of the damping sleeve 15.

A further damping element 22 is located on the outer peripheral surface 21 of the damping sleeve 15. The damping element 22 is made of sound absorbing material, and has protuberances or humps 23 which are conical or pyramidal. The free ends of the protuberances 23 engage the peripheral surface 21 of the damping sleeve 15. The protuberances 23 are arranged in a staggered or offset manner with respect to each other, and extend in diagonal rows which cross each other. The recesses between the protuberances 23 are connected with each other and accordingly form flow passages 24 which extend in a zigzag manner. The flow passages 24 are connected above with the passages 20 arranged in the damping sleeve 15, and below are connected with discharge openings 25 arranged in the hood 4.

As clearly recognizable from the the drawing, the damping element 22 is embodied having a truncated cone form just like the damping sleeve 15. In this connection, the wall thickness of the damping element 22 is approximately three times greater than the wall thickness of the damping sleeve 15, and the full width of the end face 26 of the damping element 22 engages the extension 19 of the damping plate 18. The wall of the hood 4 extends more steeply than the outer surface 27 of the damping element 22, so that a free space 28, which tapers downwardly like a wedge, is formed between the inner surface 13 and the outer surface 27.

The suction or vacuum intake air, with the suction apparatus 10 running, passes through the suction hose 7 into the lower part 3 of the housing 2 of the vacuum cleaner 1. The dust is separated by the filters 12 and 12*a* and remains in the region of the lower part 3. The filtered vacuum intake air flows through the blower 11 into the blower chamber 29, which is limited laterally and above by the damping sleeve 15 and the damping plate 18 respectively. The filtered air is conveyed further through the opening 20 and the flow passage 24 to the discharge openings 25, and from there the filtered air is discharged into the atmosphere.

The present invention is, of course, in no way restricted to the specific disclosure of the specification and drawing, but also encompasses any modifications within the scope of the appended claims.

What I claim is:

1. A vacuum cleaner, comprising:

a housing having a hood and at least one suction connection and at least one discharge opening, said hood having an inner surface;

a dust filter interposed between said suction connection and said discharge opening;

a suction apparatus which is surrounded by said hood and includes a blower and an electric motor; and a noise damping device arranged between said inner surface of said hood and said suction apparatus, said noise damping device including a damping sleeve which surrounds said suction apparatus in the manner of a mantle, said damping sleeve being in the form of a truncated cone, and being provided on one end with a damping plate which covers said suction apparatus.

2. A vacuum cleaner according to claim 1, in which the taper of said truncated-cone shaped damping sleeve extends in the flow direction of said suction apparatus, that end face of said damping sleeve which is remote from said damping plate facing said dust filter, said damping sleeve being provided with at least one opening in the vicinity of said damping plate.

3. A vacuum cleaner according to claim 2, which includes a damping element arranged on the outer peripheral surface of said damping sleeve, with at least one flow passage being arranged between said damping element and said damping sleeve, the starting region of said flow passage being connected with said opening of said damping sleeve, and the end region of said flow passage being connected with said discharge opening in said hood.

4. A vacuum cleaner according to claim 3, in which said damping element is provided with projecting humps which extend into said flow passage.

5. A vacuum cleaner according to claim 4, in which said humps are essentially conical or pyramidal, the free ends of said humps engaging said peripheral surface of said damping sleeve.

6. A vaccum cleaner according to claim 5, in which said humps are staggered relative to one another in such a way as to divert flow in said flow passage in an essentially zigzag manner.

7. A vaccum cleaner according to claim 4, in which the total thickness of said damping element is greater than the wall thickness of said damping sleeve.

8. A vacuum cleaner according to claim 4, in which said damping element, essentially like said damping sleeve, is in the shape of a truncated cone.

9. A vacuum cleaner according to claim 4, in which said damping plate includes an extension which extends beyond said damping sleeve, one end face of said damping element engaging said extension.

10. A vacuum cleaner according to claim 4, in which said damping element and said hood are arranged relative to one another in such a way that a free space is formed between said inner surface of said hood and the outer surface of said damping element.

* * * * *